US009445470B2

(12) United States Patent
Wang et al.

(10) Patent No.: US 9,445,470 B2
(45) Date of Patent: Sep. 13, 2016

(54) LED CONTROL CIRCUIT WITH SELF-ADAPTIVE REGULATION

(71) Applicant: DynaScan Technology Corp., Taoyuan County (TW)

(72) Inventors: Tsun-I Wang, Taoyuan County (TW); Ching-Chun Wu, Taoyuan County (TW); Chia-Liang Yang, Taoyuan County (TW)

(73) Assignee: DYNASCAN TECHNOLOGY CORP., Taoyuan County (TW)

( * ) Notice: Subject to any disclaimer, the term of this patent is extended or adjusted under 35 U.S.C. 154(b) by 106 days.

(21) Appl. No.: 14/316,571

(22) Filed: Jun. 26, 2014

(65) Prior Publication Data

US 2015/0382415 A1 Dec. 31, 2015

(51) Int. Cl.
*H05B 37/00* (2006.01)
*H05B 33/08* (2006.01)

(52) U.S. Cl.
CPC ..... *H05B 33/0827* (2013.01); *H05B 33/083* (2013.01); *H05B 33/0815* (2013.01); *H05B 33/0845* (2013.01)

(58) Field of Classification Search
CPC ..... H05B 33/083; H05B 33/0815; H05B 33/0824; H05B 33/0803; H05B 33/0806; H05B 33/0848; H05B 33/0821; H05B 33/0884; H05B 33/089
USPC ..... 315/291, 122, 185 R, 308, 186, 188, 315/193, 247, 297, 307, 360
See application file for complete search history.

(56) References Cited

U.S. PATENT DOCUMENTS

| | | | | |
|---|---|---|---|---|
| 7,688,002 | B2 * | 3/2010 | Ashdown | H05B 33/0818 315/185 S |
| 8,324,840 | B2 * | 12/2012 | Shteynberg | H05B 33/083 315/185 R |
| 9,107,264 | B2 * | 8/2015 | Yu | H05B 33/083 315/122 |
| 2004/0233145 | A1 * | 11/2004 | Chiang | H05B 33/083 345/82 |
| 2008/0068192 | A1 * | 3/2008 | Ashdown | H05B 33/0818 340/664 |
| 2010/0123403 | A1 * | 5/2010 | Reed | H05B 33/0815 315/193 |
| 2011/0199003 | A1 * | 8/2011 | Muguruma | H05B 33/083 315/122 |
| 2011/0227490 | A1 * | 9/2011 | Huynh | H05B 33/083 315/185 R |
| 2012/0176826 | A1 * | 7/2012 | Lazar | H02M 3/158 363/126 |
| 2013/0026925 | A1 * | 1/2013 | Ven | H05B 33/0824 315/122 |
| 2014/0210351 | A1 * | 7/2014 | Yu | H05B 33/083 315/122 |

FOREIGN PATENT DOCUMENTS

TW I220047 B 8/2004

* cited by examiner

*Primary Examiner* — Haissa Philogene
*Assistant Examiner* — Borna Alaeddini
(74) *Attorney, Agent, or Firm* — Maschoff Brennan

(57) ABSTRACT

An LED control circuit comprises a driver, a counter, and a controller and is configured to control a plurality of light-emitting units, each of which comprises at least one LED and a switch. The driver receives an alternating-current signal to output a driving signal whereby the light-emitting units are enabled. The counter begins a count from a start number when a voltage value of the driving signal equals a base value. When the count reaches a predetermined number, the controller controls the switch of at least one of the light-emitting units, causing the LED of the light-emitting unit to receive the driving signal. When the LED of the light-emitting unit receives the driving signal, the controller detects whether the light-emitting unit is enabled and adjusts the predetermined number accordingly.

7 Claims, 5 Drawing Sheets

LED CONTROL CIRCUIT WITH SELF-ADAPTIVE REGULATION

TECHNICAL FIELD

The present invention relates to an LED (light-emitting diode) control circuit, particularly to one with self-adaptive regulation.

BACKGROUND

The application of LEDs, from the lighting industry's point of view, is rooted in their compactness, longevity, power efficiency, and facility to be driven. Consequently, more and more lighting devices are seeing their conventional sources of light replaced with LEDs. An LED generally operates under a forward voltage; that is, the LED is electrically excited to emit visible light when a power source applies more than a critical voltage across the two leads of the LED. The more electric current flows through the LED, the brighter the emitted visible light. In practice, however, the electric current is often fixed or limited to a certain number of amperes, so as to maintain a consistent and stable luminance and lengthen the life of the LED.

Please refer to FIG. 1, which illustrates an LED driving circuit in prior art. Republic of China (Taiwan) Patent No. I220047 discloses an LED driving circuit 10 that directly drives LEDs by the forward portion of a power supply's voltage without filtering capacitors. The LED driving circuit 10 comprises a power supply 11, a bridge rectifier 12, a current guiding-control circuit 13 consisting of a plurality of current control units I1 to In, and a voltage detecting circuit 14 for detecting the voltage level of the power supply 11. The current control unit I1 closes to enable the LED D1 when the voltage detecting circuit 14 detects that the alternating-current voltage exceeds the critical voltage of the LED D1. Then the current control unit I1 opens and the current control unit I2 closes to enable the LEDs D1 and D2 when the voltage detecting circuit 14 detects that the alternating-current voltage exceeds the critical voltage of the LEDs D1 and D2.

As shown in FIG. 1, the LEDs D1 to Dn are enabled repeatedly on different current paths at different times and thus do not have the same brightness. The LEDs D1 to Dn decay at various rates because the electric current flows through them for different amounts of time. In the long term, it will be apparent that luminance across the LEDs D1 to Dn is not uniform.

SUMMARY

In view of the above, an objective of the present invention is to provide an LED control circuit with self-adaptive regulation, thereby controlling and driving LEDs more accurately.

The present invention discloses an LED control circuit configured to control a plurality of light-emitting units and comprising a driver, a counter, and a controller. Each of the light-emitting units comprises at least one LED and a switch. The driver receives an alternating-current signal to output a driving signal whereby the light-emitting units are enabled. The counter begins a count from a start number when a voltage value of the driving signal equals a base value. When the count reaches a predetermined number, the controller controls the switch of at least one of the light-emitting units, causing the LED of the light-emitting unit to receive the driving signal. When the LED of the light-emitting unit receives the driving signal, the controller detects whether the light-emitting unit is enabled and adjusts the predetermined number accordingly.

BRIEF DESCRIPTION OF THE DRAWING

The present invention will become more fully understood from the detailed description given hereinbelow and the accompanying drawings which are given by way of illustration only and thus are not limitative of the present invention and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
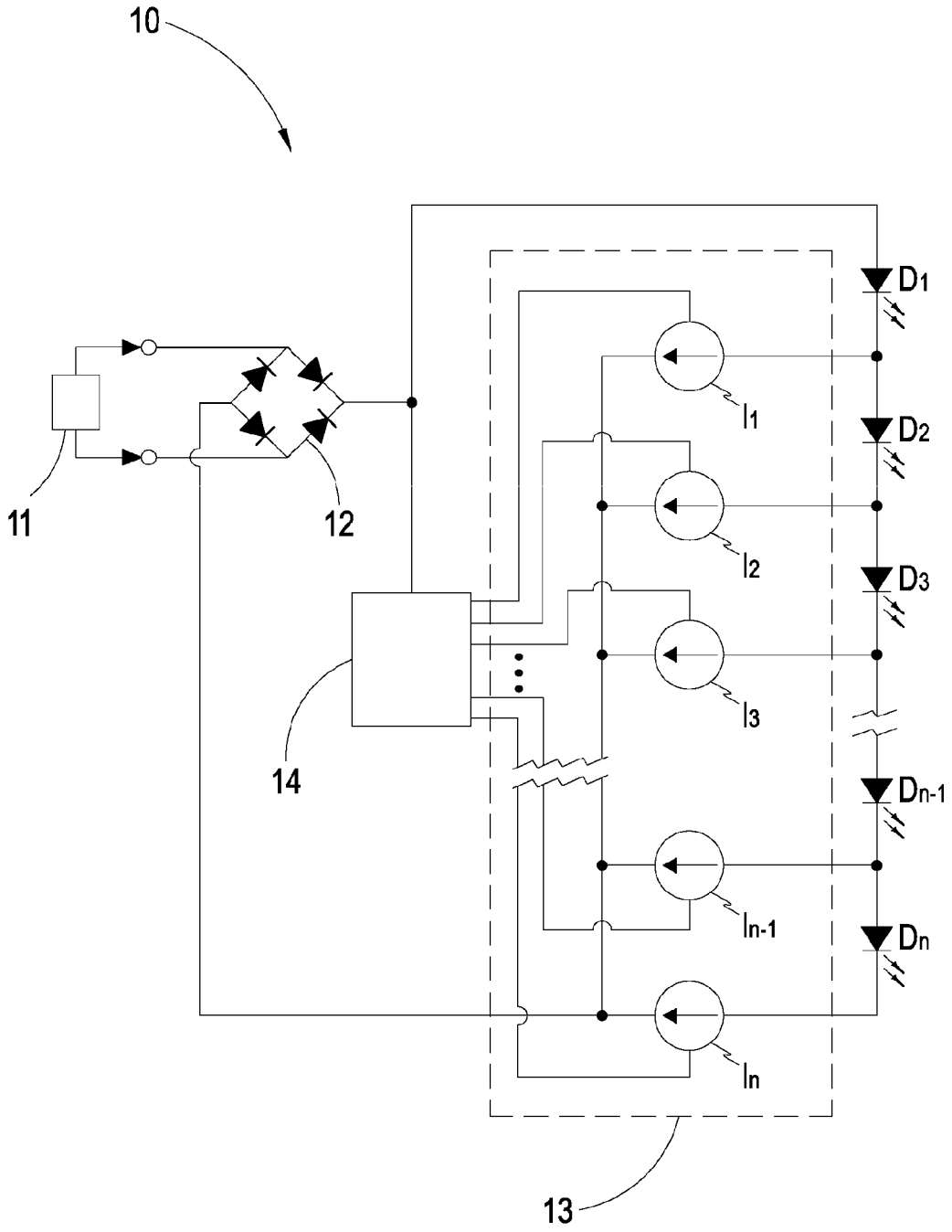
FIG. 1 (Prior Art)
FIG. 1 illustrates an LED driving circuit in prior art.
Figure 2:
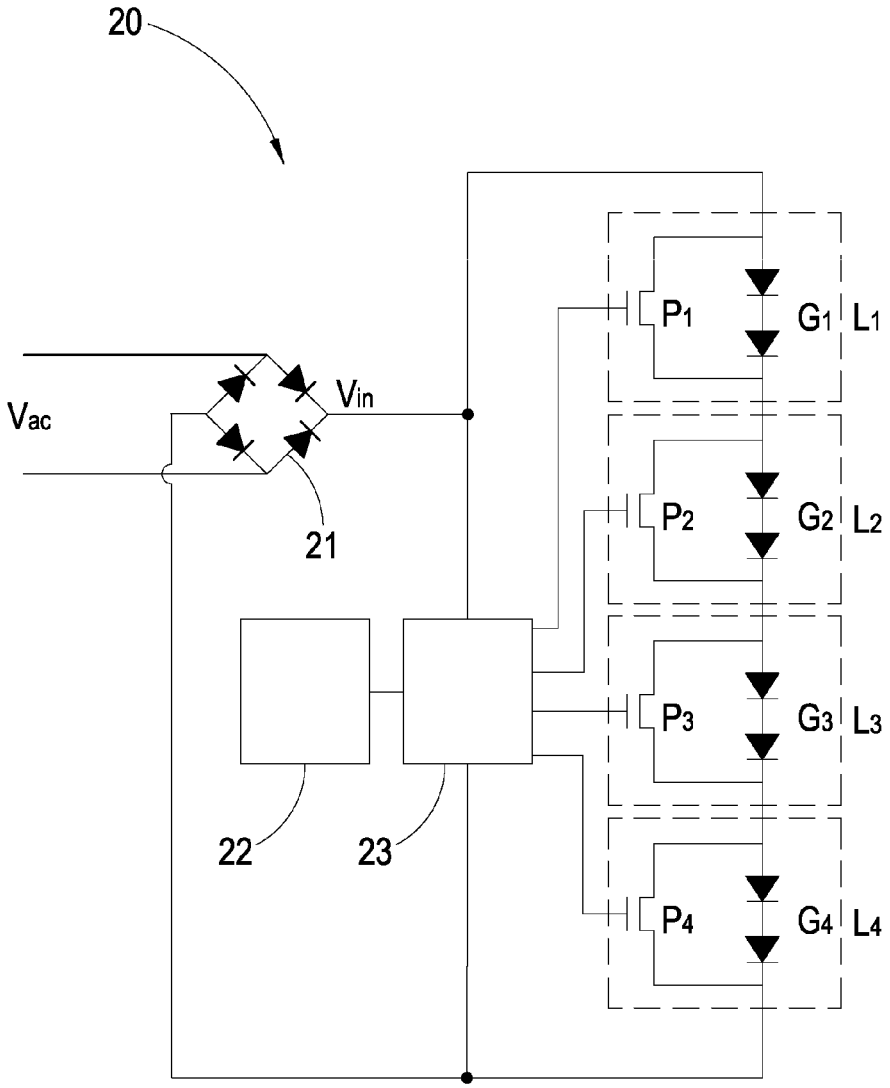
FIG. 2 depicts an LED control circuit in accordance with a first embodiment of the present invention.

Please refer to FIG. 2, which depicts an LED control circuit in accordance with a first embodiment of the present invention. The LED control circuit 20 is configured to control a plurality of light-emitting units L1 to L4 and comprises a driver 21, a counter 22, and a controller 23. In the first embodiment, the four light-emitting units L1 to L4 are connected in series, and each of them comprises two LEDs connected in series and a switch connected in parallel with the two LEDs. The light-emitting unit L1, for instance, comprises the LEDs G1 and the switch P1. The driver 21 receives an alternating-current signal Vac and performs half- or full-wave rectification on it to output a driving signal Vin. The controller 23 delivers the driving signal Vin to the serially connected LEDs G1 to G4 by opening the switches P1 to P4 of the light-emitting units L1 to L4. The counter 22 begins a count from a start number (usually zero) when a voltage value of the driving signal Vin equals a base value (usually zero). When the count of the counter 22 reaches a predetermined number, the controller 23 opens the switch of at least one of the light-emitting units L1 to L4, causing the LEDs of that light-emitting unit to receive the driving signal Vin. The controller 23 also detects whether the light-emitting unit is enabled and adjusts the predetermined number accordingly.

The driving signal Vin generated by performing half- or full-wave rectification on the alternating-current signal Vac is a half sinusoid. The larger the voltage value of the driving signal Vin, the more LEDs connected in series can be driven. When the switches of at least two of the light-emitting units L1 to L4 are open, the LEDs of the light-emitting units are all serially connected. The controller 23 can therefore set the number of enabled light-emitting units according to the voltage value of the driving signal Vin, and control through the counter 22 the amount of time for which a light-emitting unit is enabled. When the count of the counter 22 reaches the predetermined number, the controller 23 delivers the driving signal Vin to the LEDs by opening the switch of the light-emitting unit. The controller 23 determines whether the light-emitting unit is enabled usually by detecting the electric current of the LEDs. Consequently, the LED control circuit 20 with self-adaptive regulation drives and controls the LEDs using the counter 22 and adjusts the count of the counter 22 by detecting whether the light-emitting unit is enabled, so as to control more accurately the amount of time for which the light-emitting unit is enabled.

Figure 3A:
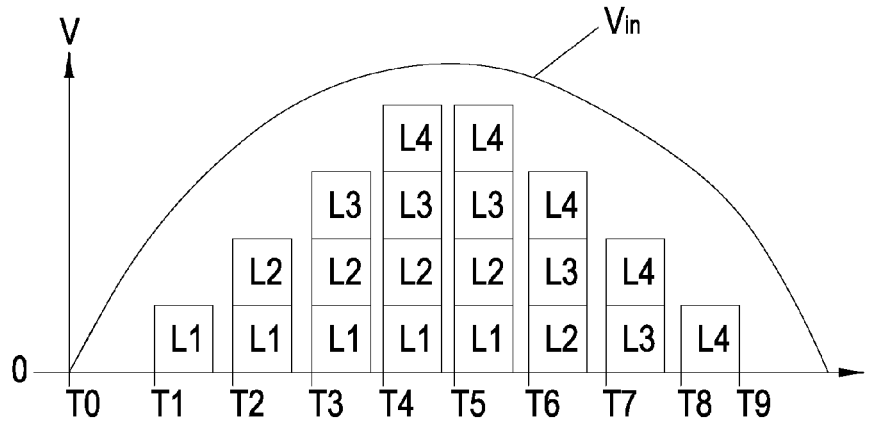
FIGS. 3A to 3C illustrate in timing diagrams the operation of the LED control circuit of the first embodiment.
Figure 3B:
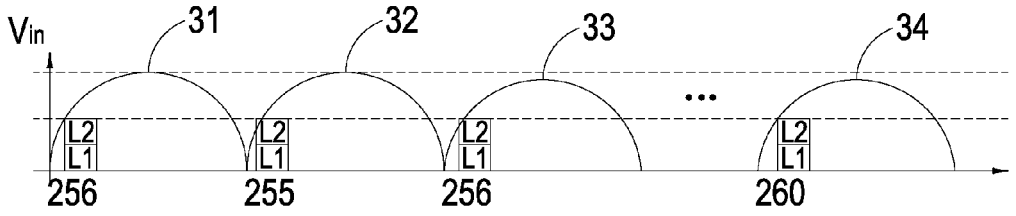
Figure 3C:
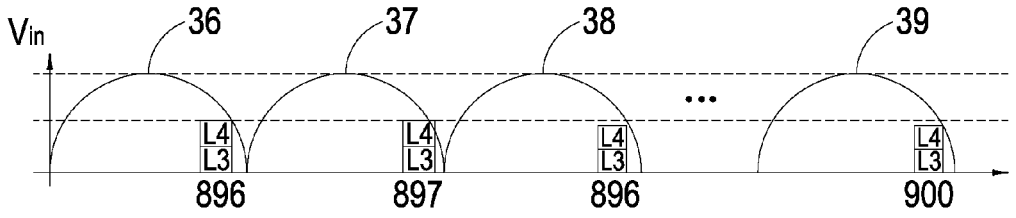

Please refer to FIGS. 3A to 3C, which illustrate in timing diagrams the operation of the LED control circuit 20 of the first embodiment. The vertical axes signify voltage values; the horizontal axes represent time in terms of the count. As shown in FIG. 3A, the counter 22 begins the count from T0 when the voltage value of the driving signal Vin is zero. The symbols below the half sinusoid signify the light-emitting unit(s) enabled by the controller 23 while the other light-emitting unit or units are off. For example, when the count reaches T4, the controller 23 opens the switches P1 to P4 and detects whether the light-emitting units L1 to L4 are enabled. In the first embodiment, during the count of the counter 22 from zero (i.e. during one period of the driving signal Vin as a half sinusoid), the switch of each of the light-emitting units L1 to L4 is opened by the controller 23 the same number of times. Such arrangement minimizes the difference in the amount of time for which each of the light-emitting units L1 to L4 is enabled, thereby making the luminance across the LEDs G1 to G4 uniform.

The voltage value of the driving signal yin increases when the count is between T0 and T5. During this interval, the controller 23 decreases the predetermined number if it detects that a light-emitting unit is enabled and increases the predetermined number if it detects that the light-emitting unit is not enabled. Suppose that the predetermined number of T2 is 256. When the count reaches 256, the controller 23 opens the switches P1 and P2 and detects whether the light-emitting units L1 and L2 are enabled. The predetermined number of T2 is adjusted to 255 if they are and to 257 if not.

On the other hand, the voltage value of the driving signal Vin decreases when the count is between T5 and T9. During this interval, the controller 23 increases the predetermined number if it detects that a light-emitting unit is enabled and decreases the predetermined number if it detects that the light-emitting unit is not enabled. Suppose that the predetermined number of T7 is 896. When the count reaches 896, the controller 23 opens the switches P3 and P4 and detects whether the light-emitting units L3 and L4 are enabled. The predetermined number of T7 is adjusted to 897 if they are and to 895 if not.

Compared to prior art, the LED control circuit 20 of the present invention can self-adapt to an optimal driving control under the voltage variation of an alternating-current source or when the critical voltage of LEDs is drifting. FIG. 3B shows the self-adaptation by the controller 23 under the voltage variation of an alternating-current source. The source stable, the controller 23 opens the switches P1 and P2 when the count reaches the predetermined number 256. By this time the voltage value of the driving signal 31 has exceeded the critical voltage value of the LEDs. The controller 23 opens the switches P1 and P2 when the count reaches 255 during the next period. Because the voltage value of the driving signal 32 is smaller than the critical voltage value of the LEDs, the predetermined number is again adjusted to 256. When the instability of the source renders the driving signal 33 weak, the controller 23 increases the predetermined number during subsequent periods. The voltage value of the driving signal 34 is larger than the critical voltage value of the LEDs as the controller 23 opens the switches P1 and P2 when the count reaches 260. The predetermined number is adjusted thereat to 259.

FIG. 3C shows the self-adaptation by the controller 23 when the critical voltage of LEDs is drifting. The controller 23 opens the switches P3 and P4 when the count reaches the predetermined number 896. By this time the voltage value of the driving signal 36 has exceeded the critical voltage value of the LEDs. The controller 23 opens the switches P3 and P4 when the count reaches 897 during the next period. Because the voltage value of the driving signal 37 is smaller than the critical voltage value of the LEDs, the predetermined number is again adjusted to 896. When the critical voltage of LEDs is drifting, the voltage value of the driving signal 38 is larger than the critical voltage value of the LEDs, and the controller 23 increases the predetermined number during subsequent periods. The voltage value of the driving signal 39 is larger than the critical voltage value of the LEDs as the controller 23 opens the switches P3 and P4 when the count reaches 900. The predetermined number is adjusted thereat to 899.

With regard to the operation of the LED control circuit 20, it can be deduced from the above that, with the controller 23 detecting whether a light-emitting unit is enabled and adjusting the predetermined number accordingly, the predetermined number will be eventually adjusted to an optimum even if initially there is a relatively big gap between the predetermined number and the optimum. In other words, the LED control circuit 20 self-adapts in the face of signal variation. Moreover, the accuracy of the switch control depends on the counting ability of the counter 22. For instance, the accuracy of the switch control is a microsecond when the counter 22 counts a million times per second. Accuracy is therefore readily controlled in the LED control circuit of the present invention.

Figure 4:
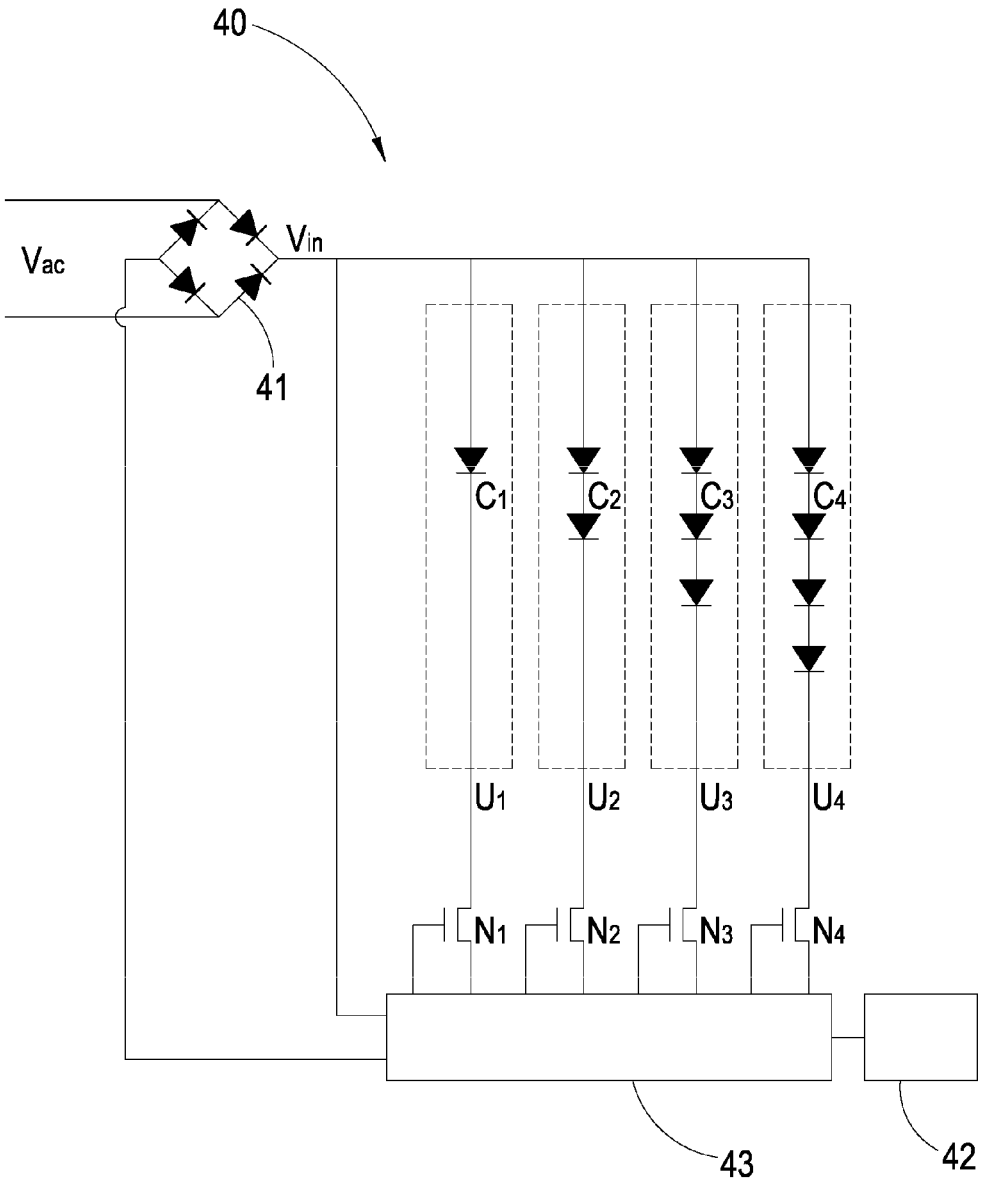
FIG. 4 depicts an LED control circuit in accordance with a second embodiment of the present invention.

Please refer to FIG. 4, which depicts an LED control circuit in accordance with a second embodiment of the present invention. The LED control circuit 40 is configured to control a plurality of light-emitting units U1 to U4 and comprises a driver 41, a counter 42, and a controller 43. In the second embodiment, the four light-emitting units U1 to U4 are connected in parallel and comprise respectively one to four LEDs connected in series as well as switches connected in series with the LEDs. The light-emitting unit U1, for instance, comprises the LED C1 and the switch N1. The driver 41 receives an alternating-current signal Vac to output a driving signal Vin. The controller 43 delivers the driving signal Vin to the LEDs C1 to C4 by closing the switches N1 to N4 of the light-emitting units U1 to U4. As in the first embodiment, the counter 42 begins a count from a start number (usually zero) when a voltage value of the driving signal Vin equals a base value (usually zero). When the count of the counter 42 reaches a predetermined number, the controller 43 closes the switch of at least one of the light-emitting units U1 to U4, causing the LED(s) of that light-emitting unit to receive the driving signal Vin. The controller 43 also detects whether the light-emitting unit is enabled and adjusts the predetermined number accordingly.

Figure 5:
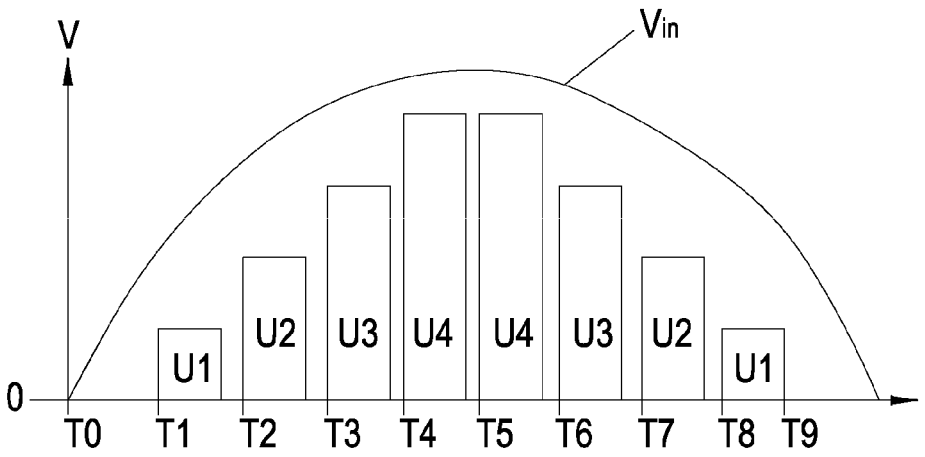
FIG. 5 illustrates in a timing diagram the operation of the LED control circuit of the second embodiment.

Please refer to FIG. 5, which illustrates in a timing diagram the operation of the LED control circuit 40 of the second embodiment. Given that the four light-emitting units U1 to U4 have discrepant numbers of serially connected LEDs, the controller 43 is able to set the number of enabled light-emitting units according to the voltage value of the driving signal Vin, and control through the counter 42 the amount of time for which a light-emitting unit is enabled.

For example, the controller 43 closes the switch N1 when the count reaches T1. The predetermined number of T1 is increased if the controller 43 detects that the light-emitting unit U1 is not enabled. The voltage value of the driving signal Vin increasing, the controller 43 closes the switch N3 when the count reaches T3. The predetermined number of T3 is decreased if the controller 43 detects that the light-emitting unit U3 is enabled. The voltage value of the driving signal Vin decreases when the count exceeds T5. When the count reaches T7, the controller 43 closes the switch N2. The predetermined number of T7 is increased if the controller 43 detects that the light-emitting unit U2 is enabled; otherwise the predetermined number of T7 is decreased. Moreover, the controller 43 sequentially enables the light-emitting units U1 to U4 by the number of LEDs they have. During the count of the counter 42 from zero, the switch of each of the light-emitting units U1 to U4 is closed by the controller 43 the same number of times.

To summarize, the LED control circuit of the present invention comprises a driver, a counter, and a controller and is configured to control a plurality of light-emitting units, each of which comprises at least one LED and a switch. The driver receives an alternating-current signal to output a driving signal whereby the light-emitting units are enabled. The counter resets and begins a count when a voltage value of the driving signal equals a base value. When the count reaches a predetermined number, the controller controls the switch of at least one of the light-emitting units, causing the LED of the light-emitting unit to receive the driving signal. When the LED of the light-emitting unit receives the driving signal, the controller detects whether the light-emitting unit is enabled and adjusts the predetermined number accordingly. The LED control circuit with self-adaptive regulation drives and controls the LEDs using the counter and adjusts the count in real time, thereby controlling more accurately the amount of time for which the light-emitting unit is enabled.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments of the invention. It is intended, therefore, that the specification and examples be considered as exemplary only, with a true scope and spirit of the invention being indicated by the following claims and their full scope of equivalents.

What is claimed is:

1. A LED (light-emitting diode) control circuit with self-adaptive regulation and configured to control a plurality of light-emitting units, each of the light-emitting units comprising at least one LED and a switch, the LED control circuit comprising:

a driver configured to output a driving signal to enable the light-emitting units during a period according to an alternating-current signal, and a voltage value of the driving signal increasing and then decreasing during the period;

a counter configured to reset and begin a count from a start number when the voltage value of the driving signal equals a base value during the period; and a controller configured to control the switch of at least one of the light-emitting units according to the count;

wherein when the voltage value of the driving signal is increasing and the count is equal to a first predetermined number, the controller controls the switch of at least one of the light-emitting units and detects whether the light-emitting unit is enabled by detecting a current flows through the light-emitting unit, when the controller detects that the light-emitting unit is enabled, the first predetermined number is decreased, and when the controller detects that the light-emitting unit is not enabled, the first predetermined number is increased;

wherein when the voltage value of the driving signal is decreasing and the count is equal to a second predetermined number, the controller controls the switch of at least one of the light-emitting units and detects whether the light-emitting unit is enabled, when the controller detects that the light-emitting unit is enabled, the second predetermined number is increased, and when the controller detects that the light-emitting unit is not enabled, the second predetermined number is decreased.

2. The LED control circuit of claim 1, wherein the light-emitting units are connected in series, each of the light-emitting units comprises a plurality of LEDs connected in series, and the switch of each of the light-emitting units is connected in parallel with the plurality of LEDs.

3. The LED control circuit of claim 2, wherein the controller opens the switch of at least one of the light-emitting units when the count reaches the predetermined number so that the LEDs of the light-emitting unit receives the driving signal.

4. The LED control circuit of claim 2, wherein the switch of each of the light-emitting units is opened N times during the period, wherein N is a natural number.

5. The LED control circuit of claim 1, wherein the light-emitting units are connected in parallel, each of the light-emitting units comprises a plurality of LEDs connected in series, and the switch of each of the light-emitting units is connected in series with the plurality of LEDs.

6. The LED control circuit of claim 5, wherein the controller closes the switch of at least one of the light-emitting units when the count reaches the first predetermined number so that the LEDs of the light-emitting unit receives the driving signal.

7. The LED control circuit of claim 5, wherein the switch of each of the light-emitting units is closed N times during the period, wherein the N is a natural number.

* * * * *